US005609222A

United States Patent [19]

Horbacewicz et al.

[11] Patent Number: 5,609,222

[45] Date of Patent: Mar. 11, 1997

[54] LADDER LEVELER

[76] Inventors: Theodore Horbacewicz, 198 Atkins St.; Lawrence Morse, 20 Hemlock Pl., both of Middletown, Conn. 06457

[21] Appl. No.: 452,294

[22] Filed: May 26, 1995

[51] Int. Cl.[6] ..... F06C 7/44

[52] U.S. Cl. ..... 182/203; 182/204; 182/109

[58] Field of Search ..... 182/200–205, 182/109, 111

[56] References Cited

U.S. PATENT DOCUMENTS

| | | | |
|---|---|---|---|
| 1,862,171 | 6/1937 | Baker | 182/205 |
| 2,517,771 | 8/1950 | Stefano | 182/203 |
| 2,783,928 | 3/1957 | Cox | 182/203 |
| 3,165,170 | 1/1965 | Bloney | 182/203 |
| 4,607,726 | 8/1986 | Davis | 182/204 |
| 4,984,655 | 1/1991 | Scherer | 182/204 |

*Primary Examiner*—Alvin C. Chin-Shue
*Attorney, Agent, or Firm*—Charles Blaich

[57] ABSTRACT

An improved ladder leveler which is made up of inner square bar and outer square tubes which slidably move axially in relation to each other vary the degree of extension. Locking the same by the insertion of a cotterless pin through aligning holes provided the inner bar and outer walls, the outer walls of said square tubes having ladder rung brackets which are spaced to accommodate ladder rungs; the leveler being fastened to the ladder and ladder rungs locked in place by the threaded engagement of a formed threaded pin which extends through the rung brackets and secured with a hair pin to engage a stile bracket which engages the ladders stile.

2 Claims, 7 Drawing Sheets

LADDER LEVELER

BACKGROUND OF THE INVENTION

Ladder levelers of one type or another are well known in the art. They all are designed to fit on or over either leg or stile of a ladder usually of the extension type. Most also have ladder rung encompassing means to insure that slippage of the rung will not occur. Further, many are permanently affixed to one or both legs of a ladder by passing bolts or pins through appropriately located hole in the ladder legs. A few levelers are removably attached to ladder legs. All ladder levelers have varying means to vary length of a ladder leg to accommodate various terrain. Almost all prior art ladder levelers utilize rotatable foot pads to accommodate varying slopes that ladder placement may entail.

PRIOR ART

The following art in general depicts the art found occurring in the presentation of the priority application:

| U.S. Pat. No. | Issued | Applicant |
|---|---|---|
| 3,444,631 | 06/03/69 | Smith, Roy A. |
| 4,798,263 | 01/17/89 | Harvey, David H. D. et. al. |
| 4,807,720 | 02/28/89 | Soon, Kim Y. |
| 5,174,412 | 12/29/92 | Vega, Henry M. |

None of the art reflects on the improvements found on the instant invention.

OBJECTIVE OF THE INVENTION

It is the primary objective of the invention to supply an improved ladder leveler that will meet the U.S. Occupational, Safety, Health Administration requirements for Type IA ladders [contractor grade for continuous use with a 100 lb (45.5 KG) overload].

It is another object of the invention to supply a ladder leveler wherein the rotatable foot pad may be replaced with a safety spike to positively engage the terrain.

It is yet another object of the invention to supply a ladder leveler with a threaded formed pin and bracket to removable interlock with a ladder leg or stile without need to modify the ladder leg.

SUMMARY OF THE INVENTION

The improved ladder leveler of the instant invention utilizes a square bar within a square tube to provide the extension required to adapt a ladder to varying terrain. Both inner bars and outer tube has a series of holes which when aligned are held in position by the insertions of a cotterless pin through both the inner bar and outer tube. Rung brackets are permanently affixed to the outer square tube in parallel relationship to each other to accommodate the spacing between rungs of a ladder. The rung brackets have holes aligned through which to pass threaded formed pins and which include a ladder stile bracket to positively engage the ladder stile to provide a positive safe mount by threadably engaging a wing nut and washer on the threaded end of the formed pin. Ladder rungs placed in the rung bracket are removably locked into the rung bracket by the passage of the formed pin through holes in the rung bracket and threadably clamping the formed pin through the stile clamping bracket.

DETAILED DESCRIPTION OF THE DRAWING

Figure 1:
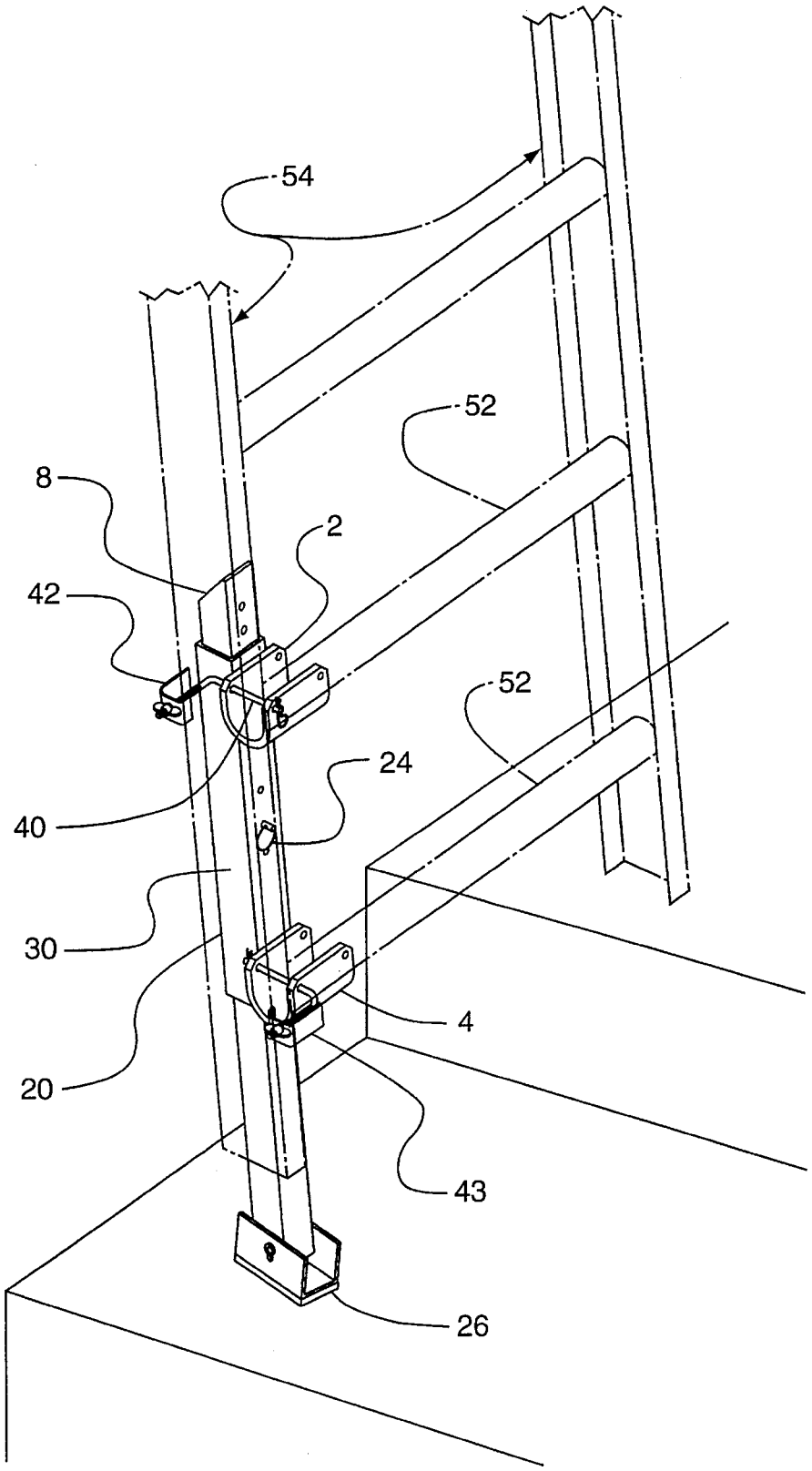
FIG. 1 depicts the instant invention on the left stile of a ladder (show in relief).
Figure 2:
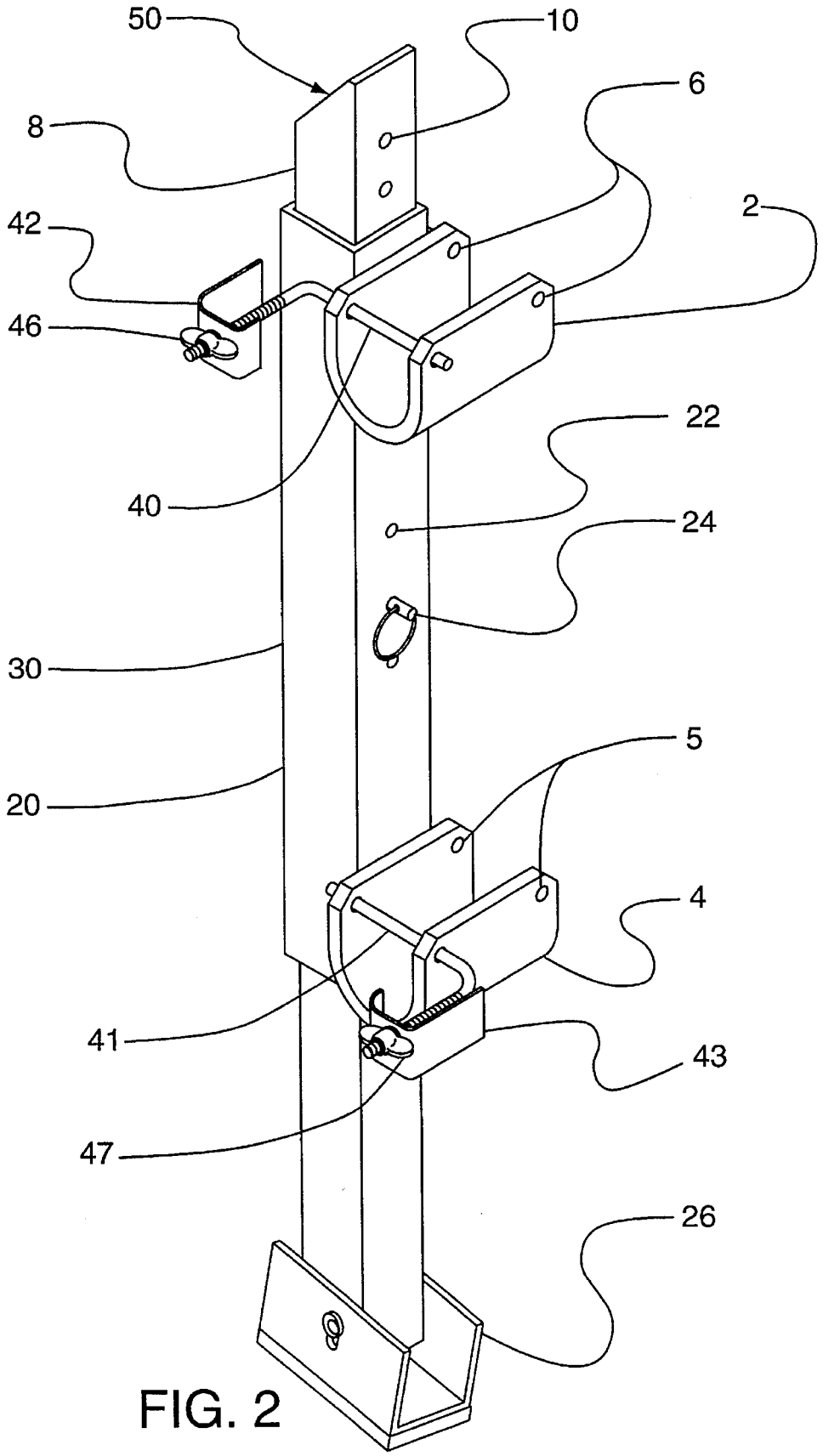
FIG. 2 depicts the instant invention assembled but not affixed to a ladder stile.
Figure 3A:
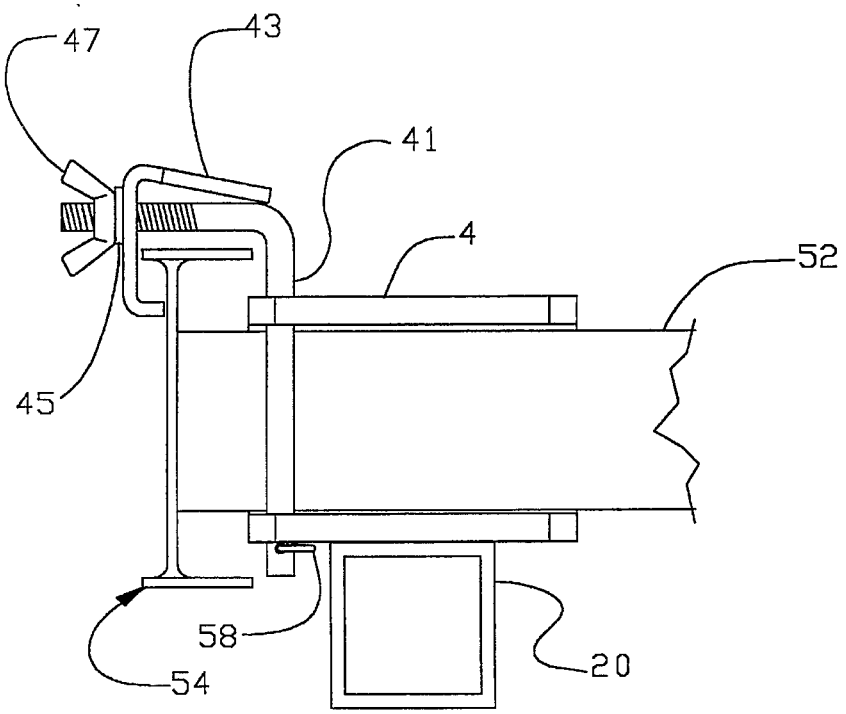
FIG. 3A depicts the lower stile clamp.
Figure 3:
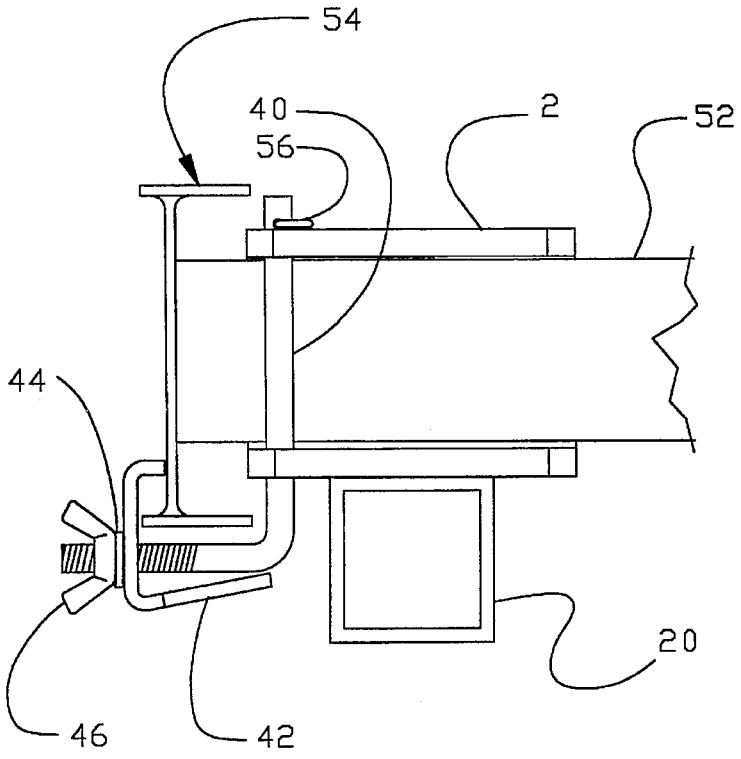
FIG. 3 depicts the threaded formed pin and stile clamp in cross sections.
Figure 4:
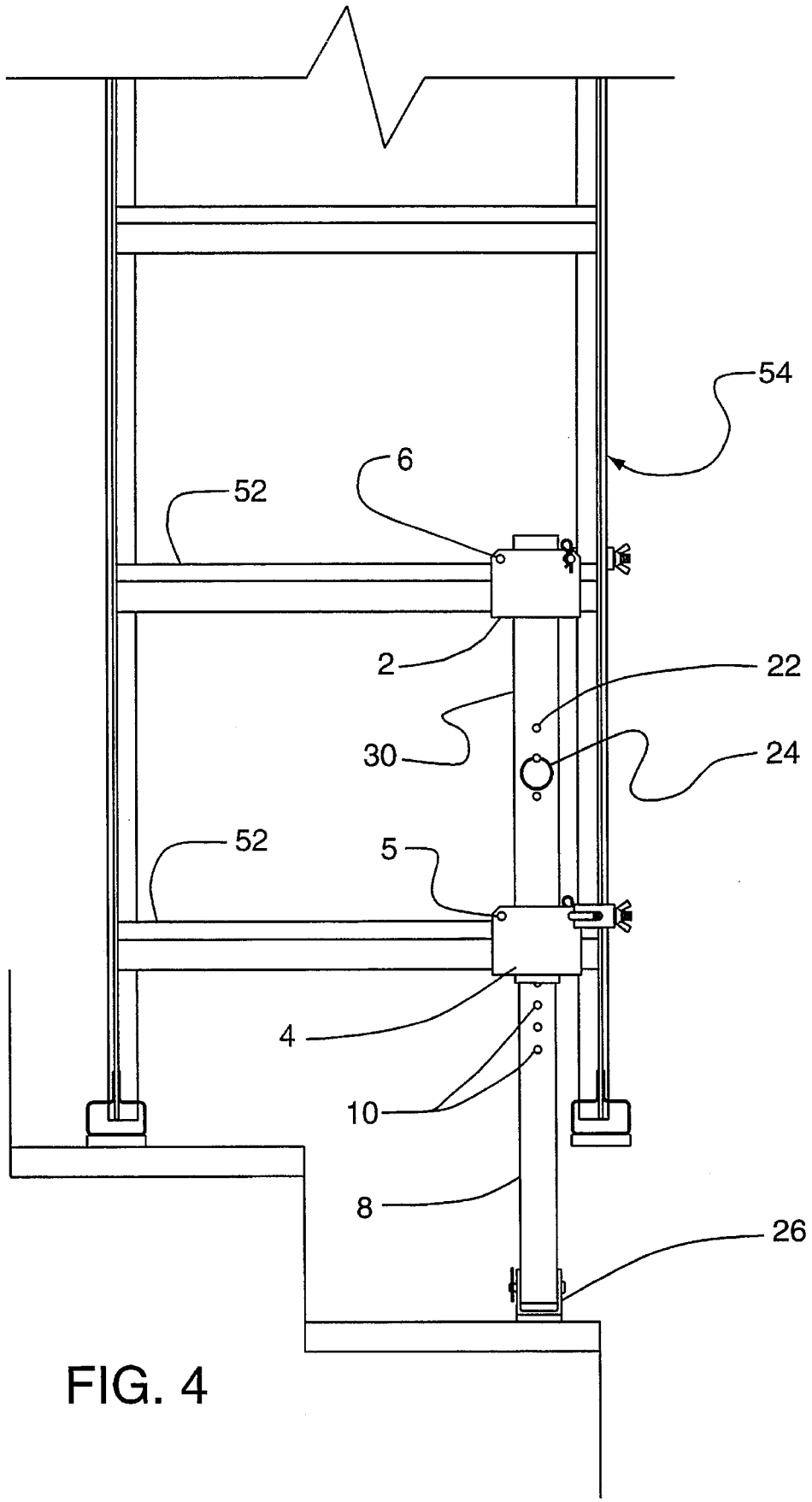
FIG. 4 is a front view of the instant ladder leveler extended to accommodate stair treads.
Figure 5:
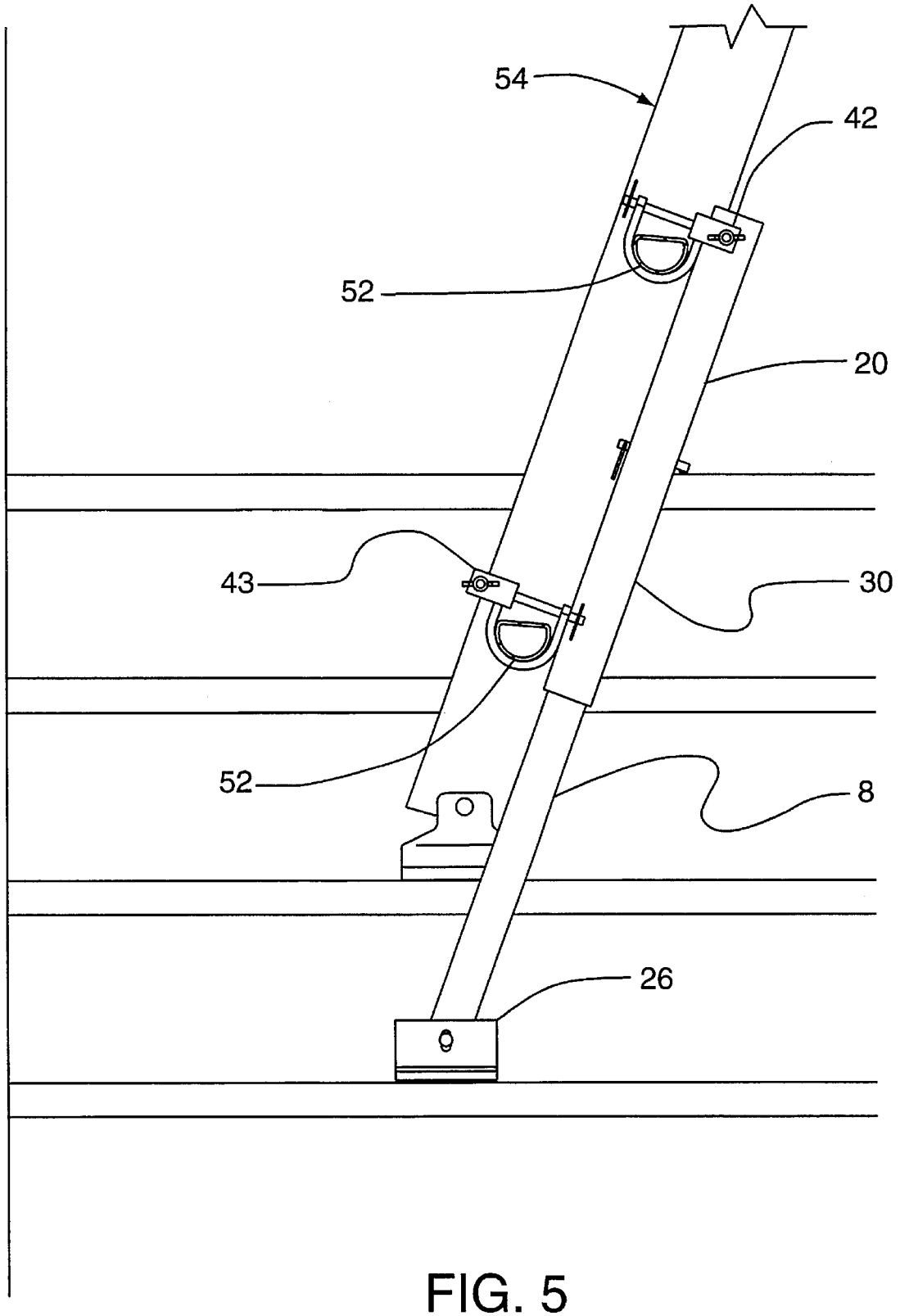
FIG. 5 is a side view of the instant ladder leveler in place on a ladder stile with the rotatable foot pad resting on a stair tread.
Figure 6:
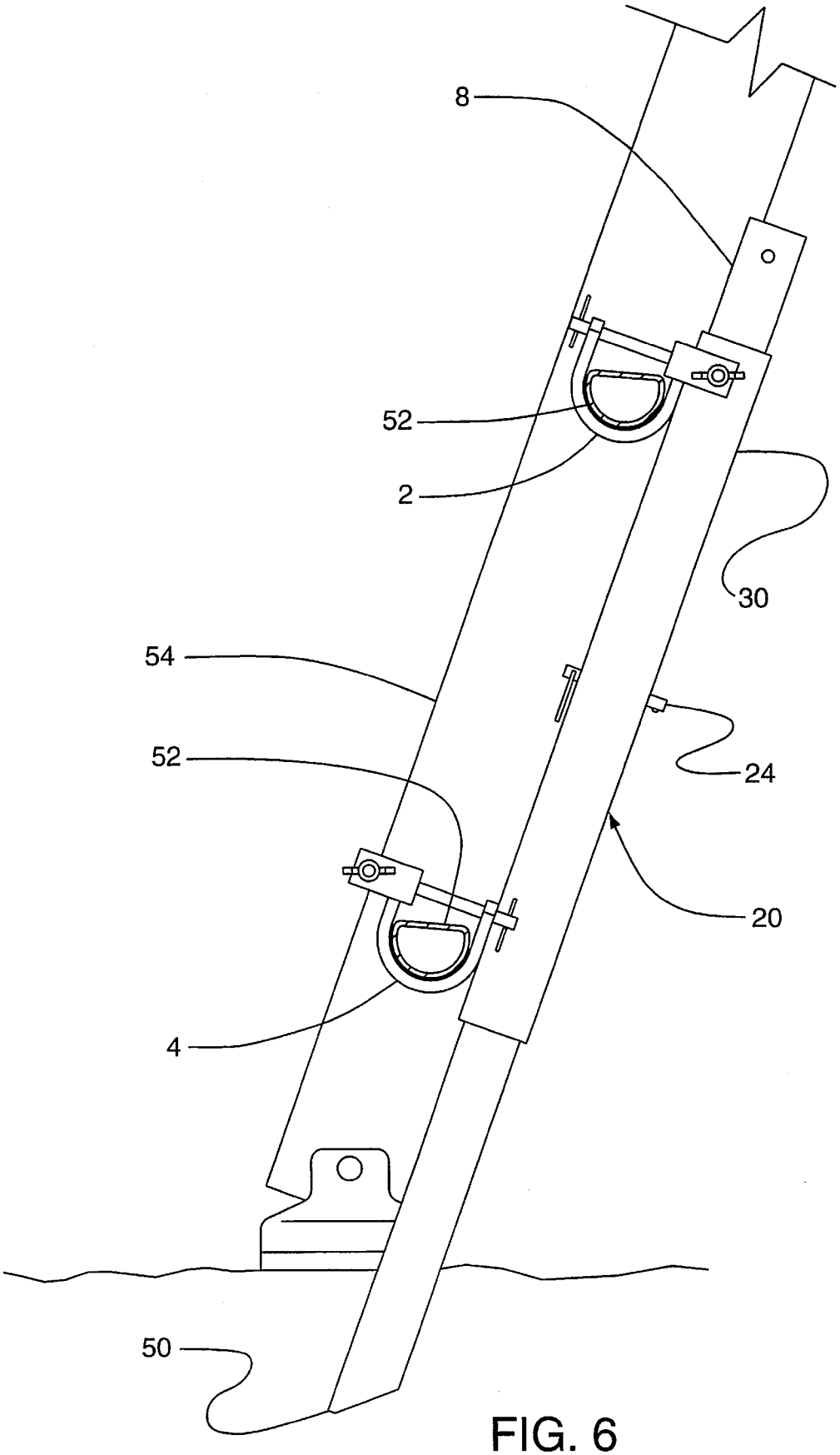
FIG. 6 is a side view of the instant ladder leveler in place on a ladder stile with the inner square bar inverted to provide a spike to penetrate varying terrain.
Figure 7:
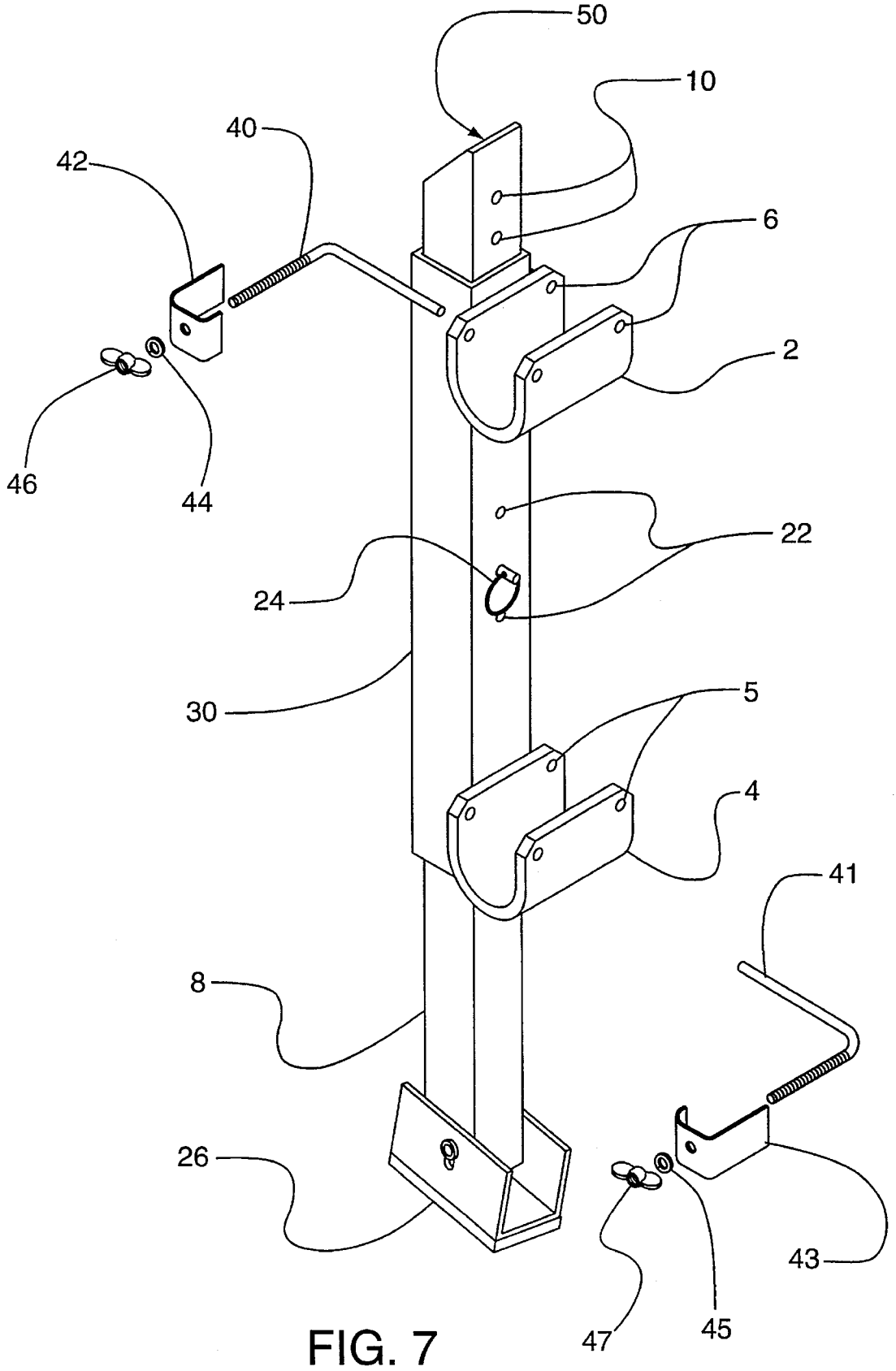
FIG. 7 is an exploded view of the instant leveler depicting the components therein.

Ladder leveler 30 shown in FIGS. 1, 2, 4, 5, 6 and 7 is made up of outer square tube 20 and inner bar 8. The inner bar 8 is freely moveable though outer tube 20. Inner bar and outer tube have alignment holes 22 and 10 respectively. As inner bar 8 is moved axially within outer tube 2 alignment holes 22 and 10 align at which point cotterless pin 24 is inserted through the inner and outer alignment holes in the wall of the inner bar and outer tubes thereby locking the extension of inner bar 20 as needed to accommodate varying levels of extension on which the ladder and affixed leveler sit. Inner square bar has a rotatable foot pad 26 affixed on its lower end as well as a pointed upper 50 end. In the instances when the terrain on which the ladder and affixed leveler is soil or other penetratable medium inner bar 8 is withdrawn from outer tube 20. Inner square bar 8 is inverted and reinserted into outer tube 20 so that the pointed end 50 extends through the lower end of outer square tube 20 to act as a spike to penetrate the terrain. When leveler is fastened onto ladder stile 54 upper and lower stile bracket 42 and 43 rungs 52 are engaged in upper and lower rung brackets 2 and 4 respectively and locked in place with upper and lower formed pins 41 and 42 which engage upper and lower stile brackets 42 and 43.

The above details are exemplary only and not limiting in scope. Such limitations being imposed by the appended claims.

What we claim is:

1. An improved ladder leveler comprising an outer square tube and inner square bar, said inner square bar being freely axially movable within said outer square tube, said inner square bar and outer square tube having perforations there through, said inner and outer perforations acting to align as said inner bar is axially moved through said outer tube, when said perforation align a cotterless pin is passed there-through thus establishing the extension of said inner bar; said outer tube having affixed thereon parallel upper and lower rung brackets, the distance between said upper and lower rung brackets being established to accommodate spacing between ladder rungs, said rung brackets having a semi-circular cross section and inner and outer side members connected to a semi-circular base, said ladder rungs supportable on said rung brackets semi-circular base said inner and outer side members of said rung brackets each having two aligned holes through which a formed threaded pin passes extendably over said ladder rung to lock the same in place in said rung brackets; said formed threaded pin subsequently passing through a stile bracket, said threaded formed pin with a lock washer, wing nut and hair pin lock for fastening said stile bracket to the said ladder stile and said ladder rung into said rung bracket.

2. The ladder leveler according to claim 1, wherein said inner square bar has two ends, the first of two ends having a rotatable pad fastened thereon, the second of said two ends being formed into a point, said point engaging with penetrable terrain.

* * * * *